US005373713A

United States Patent [19]

Miller

[11] Patent Number: 5,373,713

[45] Date of Patent: Dec. 20, 1994

[54] BI-PLY FABRIC CONSTRUCTION

[75] Inventor: Robert A. Miller, New Ringgold, Pa.

[73] Assignee: J. E. Morgan Knitting Mills, Inc., Tamaqua, Pa.

[21] Appl. No.: 124,344

[22] Filed: Sep. 20, 1993

[51] Int. Cl.[5] ..... D04B 1/14

[52] U.S. Cl. ..... 66/196; 66/202; 66/190; 66/176

[58] Field of Search ..... 66/202, 201, 198, 196, 66/190, 176, 177

[56] References Cited

U.S. PATENT DOCUMENTS

| | | | |
|---|---|---|---|
| 709,734 | 9/1902 | Bellis . | |
| 709,825 | 9/1902 | Scott . | |
| 709,826 | 9/1902 | Scott . | |
| 709,827 | 9/1902 | Scott . | |
| 709,828 | 9/1902 | Scott . | |
| 709,829 | 9/1902 | Scott . | |
| 709,839 | 9/1902 | Williams . | |
| 709,840 | 9/1902 | Williams . | |
| 709,841 | 9/1902 | Williams . | |
| 920,207 | 4/1909 | Steber | 66/202 X |
| 2,166,166 | 7/1939 | Larkin | 66/196 X |
| 2,372,497 | 3/1945 | Johnson et al. | 66/196 X |
| 2,879,654 | 3/1959 | Evans | 66/202 X |
| 2,921,457 | 1/1960 | Evans | 66/190 X |
| 4,977,782 | 4/1961 | Sheek | 66/201 X |
| 4,079,602 | 3/1978 | Blore | 66/202 X |
| 4,378,683 | 4/1983 | Matsuda et al. | 66/202 X |
| 4,678,693 | 7/1987 | Kemp | 428/91 |
| 4,797,311 | 1/1989 | Kemp | 428/92 |

*Primary Examiner*—Clifford D. Crowder
*Assistant Examiner*—John J. Calvert
*Attorney, Agent, or Firm*—Dann, Dorfman, Herrell and Skillman

[57] ABSTRACT

A knitted fabric for winterweight garments comprising two confronting webs, one overlying the other and united at intervals by a stitch of the yarn of one web engaging the other web. One of the webs has thick and thin yarns grouped in adjacent courses, the grouped courses of thick yarns alternating with the grouped courses of thin yarns to produce a ridged effect in the web. The thick yarns produce ridge lines and the thin yarns intermediate said ridge lines produce air-entrapping channels in the one web. The other web is preferably smooth on both surfaces. When fabricated into a garment the ridged web is on the inside and the smooth web is on the outside of the garment.

12 Claims, 2 Drawing Sheets

BI-PLY FABRIC CONSTRUCTION

FIELD OF THE INVENTION

The present invention relates to a knitted fabric construction and has particular application to construction of fabrics for use in winterweight garments.

BACKGROUND OF THE INVENTION

Double fabrics have been knitted together since the turn of the century. In 1902, Scott & Williams was granted U.S. Pat. No. 709,734 on a knitted fabric comprising two webs practically independent of each other but united by causing the yarn which constitutes one of the webs to engage with the other web at intervals. Tucking the two webs together in this fashion produces a double web fabric joined together. The double web fabric exhibits many desirable characteristics, not the least of which is the ability to have an outer face formed of fibers which are distinctly different from the fibers which form the inner face. At the time of the original invention, a wool outer face combined with a cotton inner face provided a desirable combination of warmth and comfort which was not available in the absence of two distinct webs.

Over the years, the composition of fabrics formed in this fashion has developed so as to produce a wide variety of desirable so-called bi-ply fabrics. For example, the two plies of fabrics are substantially independent of one another so that each of the fabrics may be knitted with characteristics which complement the other and the double knitting produces a composite bi-ply fabric which has characteristics which are not possessed by either ply alone.

SUMMARY OF THE INVENTION

The bi-ply fabric of the present invention is designed to be fabricated into a winterweight garment, and is characterized by a ridged appearance in the one web which produces air pockets or valleys between the ridges to provide an insulating air barrier between the outer fabric and the inner fabric. The ridges are formed on both sides of the inside web of the fabric and thereby provide air pockets or channels on the inside surface of the bi-ply fabric, for example when the fabric is tight against the skin, and also between the webs within the interior of the bi-ply fabric. Thus, a double layer of insulating air is provided by the bi-ply fabric of the present invention, i.e. one layer at the inside surface of the bi-ply fabric and a second layer within the interior of the fabric.

The construction of the fabric of the present invention positions the ridges and valleys on opposite sides of the inner ply of the fabric in registry with one another so that the ridges on the inside surface of the inner ply are registered with the ridges on the outside surface of the inner ply which confronts the inside surface of the outer ply within the interior of the fabric.

In accordance with the present invention, the ridges produced by the fabric construction are achieved by the use of yarns of greater bulk in selected feeds of a circular knitting machine, thereby causing the rows of loops knitted from those feeds to be thicker than the rows of loops knitted from the feeds which have less bulky yarns fed thereto.

The machines used to produce bi-ply fabrics have a minimum of 5–8 yarn feeders in each set and it has been found that the best ridges are produced when the feeds are grouped within each set, for example bulky yarn used in three adjoining feeders alternating with non-bulky yarn in the remaining feeders of each set.

BRIEF DESCRIPTION OF THE DRAWINGS

All of the objects of the invention are more fully set forth hereinafter with reference to the accompanying drawings, wherein.

DESCRIPTION OF THE PREFERRED EMBODIMENT

Figure 1:
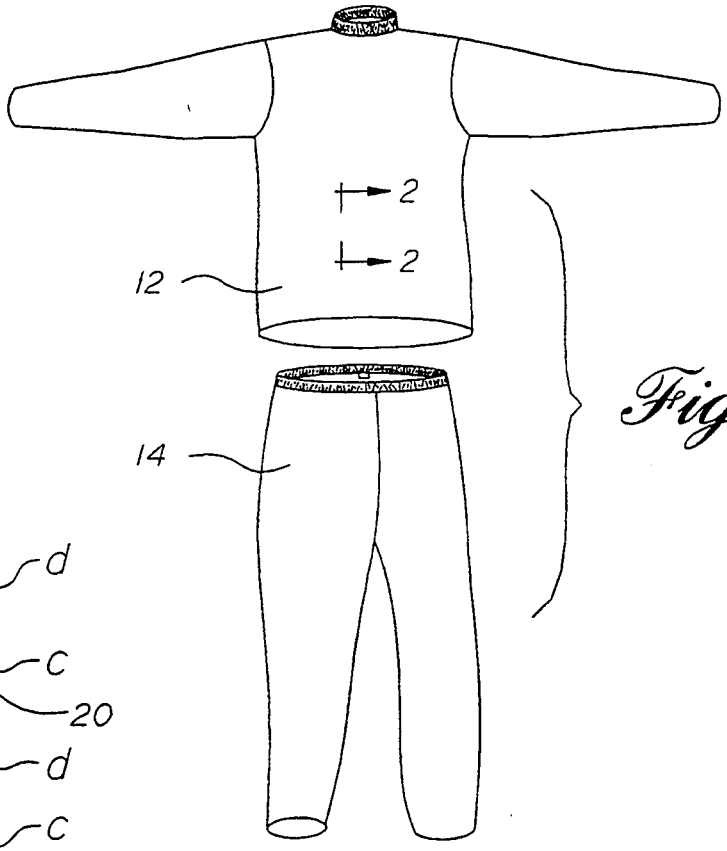
FIG. 1 is a view of a two-piece winterweight garment incorporating the bi-ply fabric of the present invention.
Figure 2:
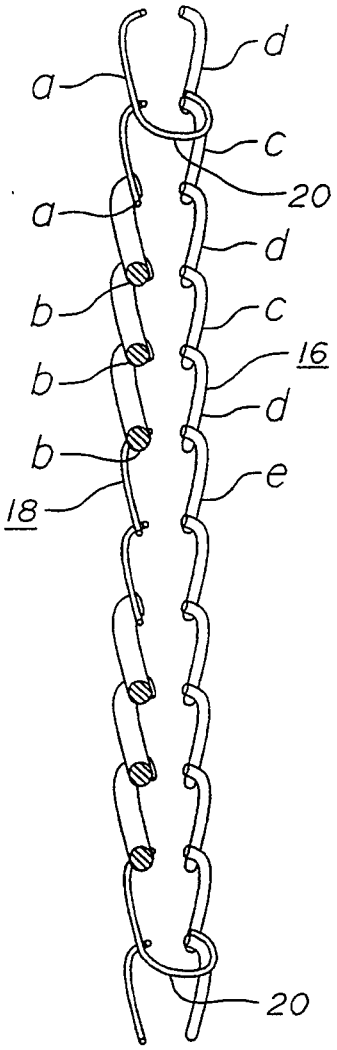
FIG. 2 is a sectional view of the bi-ply fabric, for example taken on the line 2—2 of FIG. 1.

The garment shown in FIG. 1 consists of a top 12 and a bottom 14, both made from a bi-ply fabric constituted by inner and outer knitted webs tucked together at intervals to form a composite fabric. The fabric is produced on a rotating dial and cylinder (bi-ply/jersey type) circular knitting machine, modified so each feed knits only dial or cylinder such as #1 feed knits dial welt cylinder. #2 feed knits cylinder welt dial, etc. A suitable machine is a 14-gauge machine having twenty feeds. In the present instance, the cylinder needles produce the outside ply 16 of the fabric and the dial needles form the inside ply (see FIG. 2). As shown in FIG. 2, the inner ply 18 and the outer ply 16 are interconnected at intervals by a tuck stitch 20. On the knitting machine, the outer ply 16 is formed simultaneously with the inner ply 18 to form a continuous tube of two plies of fabric which, during fabrication are positioned so that the cylinder-knitted web is on the outside of the garment and the dial-knitted web is on the inside of the garment. During the knitting of the fabric, as the cylinder rotates past the feeders, the stitch cams elevate the tuck needle every ten courses to engage behind a dial needle and form a tuck stitch to tie the two plies of the fabric together.

In accordance with the present invention, the knitting machine is set up to feed different selected yarns to the different yarn feeders so as to produce a novel effect in the bi-ply fabric.

Figure 3:
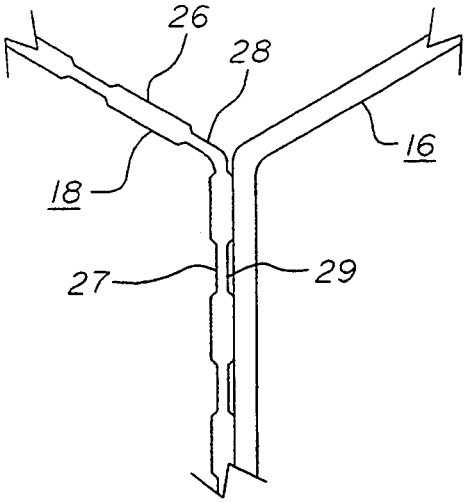
FIG. 3 is a diagrammatic view of the bi-ply fabric with the plies partially peeled away to illustrate the air pockets or channels formed by the fabric construction of the present invention.
Figure 4:
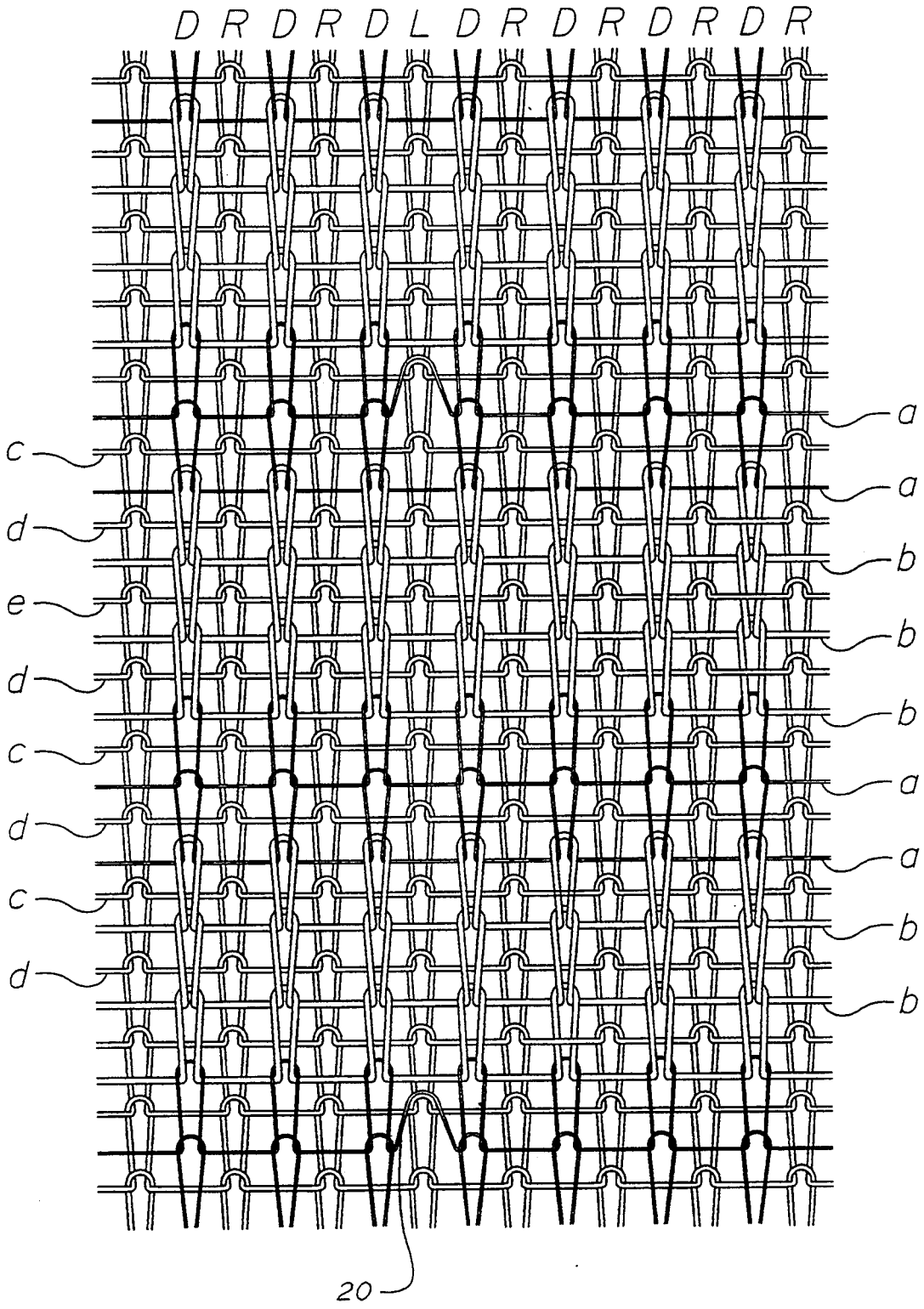
FIG. 4 is a stitch diagram as seen from the inside surface of the garment using the bi-ply fabric, the diagram illustrating the construction thereof.

Table I (below) is a chart of the knitting pattern for the fabric illustrated in FIGS. 2–4. The columns represent the positions of the regular-butt cylinder needles R, the low-butt cylinder needles L and the dial needles D respectively as the cylinder is rotated past each feed. The knit pattern repeats on 20 feeds, as shown. Each row in the chart represents a feed, and the character of the yarn at each feed is represented by the reference a, b, c or d. It is noted that the dial needles knit yarn from the odd numbered feeds, alternately. The sequence of yarns repeats over five feeds, with three feeds of yarn a forming alternate groups of adjacent courses, then two feeds of yarn b forming intermediate groups of adjacent courses.

The cylinder needles, on the other hand, knit with the yarns at the even numbered feeds and alternate between yarns c and d throughout the 20-course repeat. The stitches produced by this pattern are diagrammed in FIG. 4. Each yarn extends generally parallel to the other yarns, producing a single coursewise row of loops within the repeat. The regular butt needles form wales R in the fabric, the low butt cylinder needles form wales L. In setting up the machine, in each set of 12 cylinder needles, there may be a single low butt needle, and the remainder will be regular butt needles so that the tuck stitches are knitted in every twelfth cylinder wale. In the arrangement shown in the chart, the tuck stitches appear in every fifth course of the inner and outer plies respectively of the bi-ply fabric.

TABLE I

| Feed No. | Reg. Butt Cyl. Ndles | Low Butt Cyl. Ndles | Dial Needles | Yarn Type |
|---|---|---|---|---|
| 1 | Welt | Tuck | Knit | a |
| 2 | Knit | Knit | Welt | c |
| 3 | Welt | Welt | Knit | a |
| 4 | Knit | Knit | Welt | d |
| 5 | Welt | Welt | Knit | b |
| 6 | Knit | Knit | Welt | c |
| 7 | Welt | Welt | Knit | b |
| 8 | Knit | Knit | Welt | d |
| 9 | Welt | Welt | Knit | b |
| 10 | Knit | Knit | Welt | c |
| 11 | Welt | Welt | Knit | a |
| 12 | Knit | Knit | Welt | c |
| 13 | Welt | Welt | Knit | a |
| 14 | Knit | Knit | Welt | d |
| 15 | Welt | Welt | Knit | b |
| 16 | Knit | Knit | Welt | c |
| 17 | Welt | Welt | Knit | b |
| 18 | Knit | Knit | Welt | d |
| 19 | Welt | Welt | Knit | b |
| 20 | Knit | Knit | Welt | c |
| 21 | Welt | Tuck | Knit | a |
| 22 | Knit | Knit | Welt | c |
| 23 | Welt | Welt | Knit | a |
| 24 | Knit | Knit | Welt | d |
| 25 | Welt | Welt | Knit | b |
| 26 | Knit | Knit | Welt | c |
| 27 | Welt | Welt | Knit | b |
| 28 | Knit | Knit | Welt | d |
| 29 | Welt | Welt | Knit | b |
| 30 | Knit | Knit | Welt | c |
| 31 | Welt | Welt | Knit | a |
| 32 | Knit | Knit | Welt | c |
| 33 | Welt | Welt | Knit | a |
| 34 | Knit | Knit | Welt | d |
| 35 | Welt | Welt | Knit | b |
| 36 | Knit | Knit | Welt | c |
| 37 | Welt | Welt | Knit | b |
| 38 | Knit | Knit | Welt | d |
| 39 | Welt | Welt | Knit | b |
| 40 | Knit | Knit | Welt | c |

The outer ply has an even feed of alternating yarn types designated C and D, but all being of the same yarn size or cotton count, for example 20/1 Ne. The outer ply may alternatively have an even feed of one type of yarn of the same yarn size. Other natural or synthetic-fiber yarns may be substituted to produce any special features that may be desired in the outer ply. The inner ply, on the other hand, alternates between thick and thin cotton or synthetic yarns, for example 12/1 Ne and 26/1 Ne. The outer ply 16 provides a smooth neat appearance to the bi-ply fabric and provides an entrapment barrier to the inside channel ridge fabric, allowing it to trap the air being held in the inside channel. This speeds body moisture evaporation.

The inner ply 18, on the other hand, provides a ridged effect with the plurality of adjacent courses of the thick yarns b providing a thicker fabric which alternates with the fabric produced by the plurality of adjacent courses of thin yarns a which is thinner. This is diagrammed in FIG. 3 wherein the thicker fabric courses are shown at 26, and the thinner fabric courses are shown at 28 in the inner ply 18. The thicker fabric sections provide ridges appearing on both the inside surface of the bi-ply fabric and on the interior surface of the inner ply of the bi-ply fabric. The ridges in the inside surface of the inner ply 18 define the sides of channels or valleys 27 which lie against the body of the wearer, and the spacing between the ridges on the interior surface of the inner ply 18 provide valleys 29.

The valleys 29 are closed by the other ply 16 to provide channels within the interior of the bi-ply fabric extending in a course-wise direction. In registry with the interior valleys 29, the valleys 27 on the inner side of the inner ply provide course-wise extending voids. The voids provided by the valleys 27 and 29 enable the entrapment of air to form an insulating layer. When worn on the body, the air layers on the inside of the fabric and as well as in the interior of the fabric enhance the insulating quality of the fabric and enable the fabric to provide insulating effect which is greater than the insulating effect of a similarly weighted fabric which does not have air pockets or air entrapment. The layers provide an effective barrier against the passage of heat which is a characteristic of a solid fabric of similar thickness. The air channels provided on the opposite sides of the inner ply of the bi-ply fabric provide elevated comfort level to the body.

In the illustrated embodiment the ridges extend coursewise of the inner ply of the bi-ply fabric, since the fabric is weft-knitted on a conventional dial machine. The ridged effect in the inner web appears not only in the interface between the webs, but also on the inside surface of the fabric which bears against the torso, when used in a winterweight undergarment. The fabric designer may find that similar effects may be achieved on other knitting machines by suitable choice of yarns in accordance with the teaching of the present invention.

While particular embodiments of the invention and modifications thereof have been herein illustrated and described, it is not intended to limit the invention to such disclosures, and changes and other modification may be made therein and thereto within the scope of the following claims.

I claim:

1. A knitted fabric comprising two confronting webs, one overlying the other and united at intervals by a stitch of the yarn of one web engaging the other web, said stitches in the one web being spaced apart walewise in said web by a plurality of courses in said one web and being tied into the other web at points likewise spaced apart by a plurality of courses, each web being formed by a series of continuous lengths of yarn extending generally parallel to one another and having loops arranged in walewise and coursewise rows, one of said webs having thick and thin yarns, the thick yarns forming groups of adjacent generally parallel lengths and the thin yarns forming groups of adjacent parallel lengths, the groups of thick yarns alternating with the groups of thin yarns to produce a ridged effect in the web, with ridge lines being defined by the adjacent rows of loops of thick yarns, the groups of thin yarns intermediate said ridge lines producing air-entrapping channels in said one web.

2. A fabric according to claim 1, wherein said ridged effect appears on the surface of the one web which confronts the other web, whereby the other web is effective to close the air-entrapping channels of the one web within the interior of the knitted fabric.

3. A fabric according to claim 1, wherein said ridged effect appears on the surface of the one web which is opposite the surface which confronts the other web to provide air-entrapping channels on an outer surface of the knitted fabric.

4. A fabric according to claim 1, wherein said ridged effect appears on both surfaces of the one web, the ridges on opposite surfaces being in registry and the air-entrapping channels on opposite surfaces also being in registry.

5. A fabric according to claim 1, wherein the Ne yarn size of the thin yarns is approximately twice the Ne yarn size of the thick yarns.

6. A fabric according to claim 5, wherein the yarn size of the thick yarns is in the range of 10 Ne to 20 Ne, and the yarn size of the thin yarns is in the range of 26 Ne to 36 Ne.

7. A fabric according to claim 1, the other of said confronting webs having yarns of intermediate thickness throughout providing a substantially smooth surface on each surface of said web.

8. A winterweight garment adapted to be worn on the torso, said garment being fabricated from a knitted fabric comprising two confronting webs, one overlying the other and united at intervals by a stitch of the yarn of one web engaging the other web, said stitches in the one web being spaced apart walewise in said web by a plurality of courses in said one web and being tied into the other web at points likewise spaced apart by a plurality of courses, one of said webs having thick and thin yarns, the thick yarns being grouped in spaced-apart sequences of adjacent courses, and the thin yarns being grouped in sequences of adjacent courses between the spaced-apart sequences of adjacent courses of the thick yarns, the grouped courses of thick yarns alternating with the grouped courses of thin yarns to produce a ridged effect in the web, with ridge lines being defined by the grouped courses of thick yarns, the grouped courses of thin yarns intermediate said ridge lines producing air-entrapping channels in said one web.

9. A garment according to claim 8, wherein said ridged effect appears on the surface of the one web which confronts the other web, whereby the other web is effective to close the air-entrapping channels of the one web within the interior of the knitted fabric.

10. A garment according to claim 8, wherein said ridged effect appears on the surface of the one web which is opposite the surface which confronts the other web to provide air-entrapping channels on an outer surface of the knitted fabric, said outer surface being positioned on the inside of the fabricated garment which confronts the torso.

11. A garment according to claim 8, wherein said ridged effect appears on both surfaces of the one web, the ridges on opposite surfaces being in registry and the air-entrapping channels on opposite surfaces also being in registry, said one web being positioned on the inside of the fabricated garment which confronts the torso.

12. A garment according to claim 11, the other of said confronting webs having yarns of intermediate thickness throughout providing a substantially smooth surface on each surface of said web, said other web being positioned on the outside of the fabricated garment.

* * * * *